United States Patent [19]

Wynne

[11] 4,389,042

[45] Jun. 21, 1983

[54] VACUUM DEGASSING APPARATUS

[75] Inventor: Peter J. Wynne, Pittsburgh, Pa.

[73] Assignee: Lectromelt Corporation, Pittsburgh, Pa.

[21] Appl. No.: 336,898

[22] Filed: Jan. 4, 1982

[51] Int. Cl.[3] ..... C21B 7/10

[52] U.S. Cl. ..... 266/210; 266/142; 266/165

[58] Field of Search ..... 266/142, 143, 165, 208–211

[56] References Cited

U.S. PATENT DOCUMENTS 3,756,584 9/1973 Meuissen ..... 266/142

FOREIGN PATENT DOCUMENTS 1363131 5/1964 France .

4541482 9/1967 Japan ..... 266/210

*Primary Examiner*—L. Dewayne Rutledge

*Assistant Examiner*—Christopher W. Brody

*Attorney, Agent, or Firm*—Fred Wiviott

[57] ABSTRACT

A vacuum degassing apparatus has first and second degassing vessels each separately mounted for independent horizontal movement from a first operative position to a second repair position. In addition, each vessel is independently mounted for vertical movement in each position so that a pair of nozzles extending from its lower end to be immersed into a ladle of hot metal when the vessel is at its operative position whereby a degassing operation may be performed. Also, when the vessel is in its repair position, it may be lowered to permit repair or replacement of the nozzles or the vessel bottom as may be required. A vacuum conduit is pivotally connected to each vessel and to a fixed vacuum conduit to maintain the vacuum connection while the vessel is being moved into and out of its various positions.

15 Claims, 4 Drawing Figures

VACUUM DEGASSING APPARATUS

BACKGROUND OF THE INVENTION

This invention relates to vacuum degassing apparatus and more particularly to a vacuum degassing installation having plural vacuum degassing vessels and which is capable of continuous operation.

One type of vacuum degassing vessel includes one or more downwardly projecting nozzles for drawing metal contained in a ladle upwardly into the vessel for degasification. The lower end of the nozzle is submerged beneath the level of metal in the ladle whereby the metal is drawn at least partway into the vessel as the result of the vacuum therein. In two nozzle vessels, additional metal is conveyed upwardly through a first nozzle by some additional agencies such as a gas lift or an electromagnetic pump. The degassed metal then flows back to the ladle through the second nozzle. Examples of two nozzle vessels are shown in U.S. Pat. Nos. 2,893,860 and 2,994,602.

In single nozzle vessels, metal is moved into and out of the vacuum degassing vessel by cyclically lowering and elevating the same relative to the metal contained with the ladle. Metal is forced into the vessel when there is relative movement of the ladle and vessel toward each other and discharged when separation of the two is increased. An example of a single nozzle vessel is shown in U.S. Pat. No. 2,967,768.

In order to exclude slag which normally covers the molten metal in the ladle, slag shields or breakers are usually affixed to the lower ends of each nozzle between each successive treating cycle. These shields consist of conical shields of about the same composition as the metal being processed. As the lower end of the nozzles are submerged into the metal, the shield prevents entry of slag into the nozzle but soon melts to permit the entry of molten metal into the nozzle.

Additional routine maintenance must also be performed on vacuum degassing vessels. For example, with a typical two-nozzle vessel, slag must be removed from the nozzle and routine nozzle maintenance performed after every five heats requiring about forty-five to one hundred minutes. In addition, the nozzles must be replaced about every sixty heats requiring about one hour and twenty-five minutes. About every one hundred twenty heats, the vessel bottom must be replaced requiring about one hour and twenty-five minutes. Finally, about every 2,500 heats, the upper vessel must also be replaced requiring about six to eight hours. Thus, in an average of twenty shifts, a vessel is available for use only about 80% of the time.

Prior art attempts to increase vessel availability involve mounting a pair of vessels on a turntable with one vessel being mounted in an operative position and a second in a repair position. When it is desired to alternate vessels, the turntable is rotated to move one vessel from the operative to the repair position and the vessel previously in operation is moved to the maintenance position. Such a system is shown in U.S. Pat. No. 3,756,584. This arrangement still does not provide 100% vessel availability because of the time required to disconnect the first vessel from the vacuum system to move the first vessel out of the operative position and the second vessel into its place and then to reconnect the vacuum system to the second vessel. In addition, in such prior art systems, it was not possible to test the vacuum connections of the vessel in the repair position.

SUMMARY OF THE INVENTION

It is a primary object of the invention to provide a new and improved vacuum degassing apparatus.

Another object of the invention is to provide a vacuum degassing system which provides substantially continuous operation.

Another object of the invention is to provide a vacuum degassing apparatus having a pair of vessels movable between operative and repair positions wherein it is not necessary to disconnect the vacuum system when the vessel is moved.

A still further object of the invention is to provide a vacuum degassing apparatus having vessels movable between operative and repair positions wherein vacuum testing may be carried out in the repair position.

These and other objects and advantages of the present invention will become more apparent from the detailed description thereof taken with the accompanying drawings.

In general terms, the invention comprises a vacuum degassing apparatus including first and second vessels mounted respectively on first and second support means which are each mounted for independent horizontal movement for transporting the vessels between operative and maintenance positions which are separate from but adjacent to those of the other vessel. Each of the first and second support means are also independently mounted for vertical movement so that each vessel may be lowered toward a ladle disposed therebelow or for maintenance in the repair position.

DETAILED DESCRIPTION OF THE PREFERRED EMBODIMENT

Figure 1:
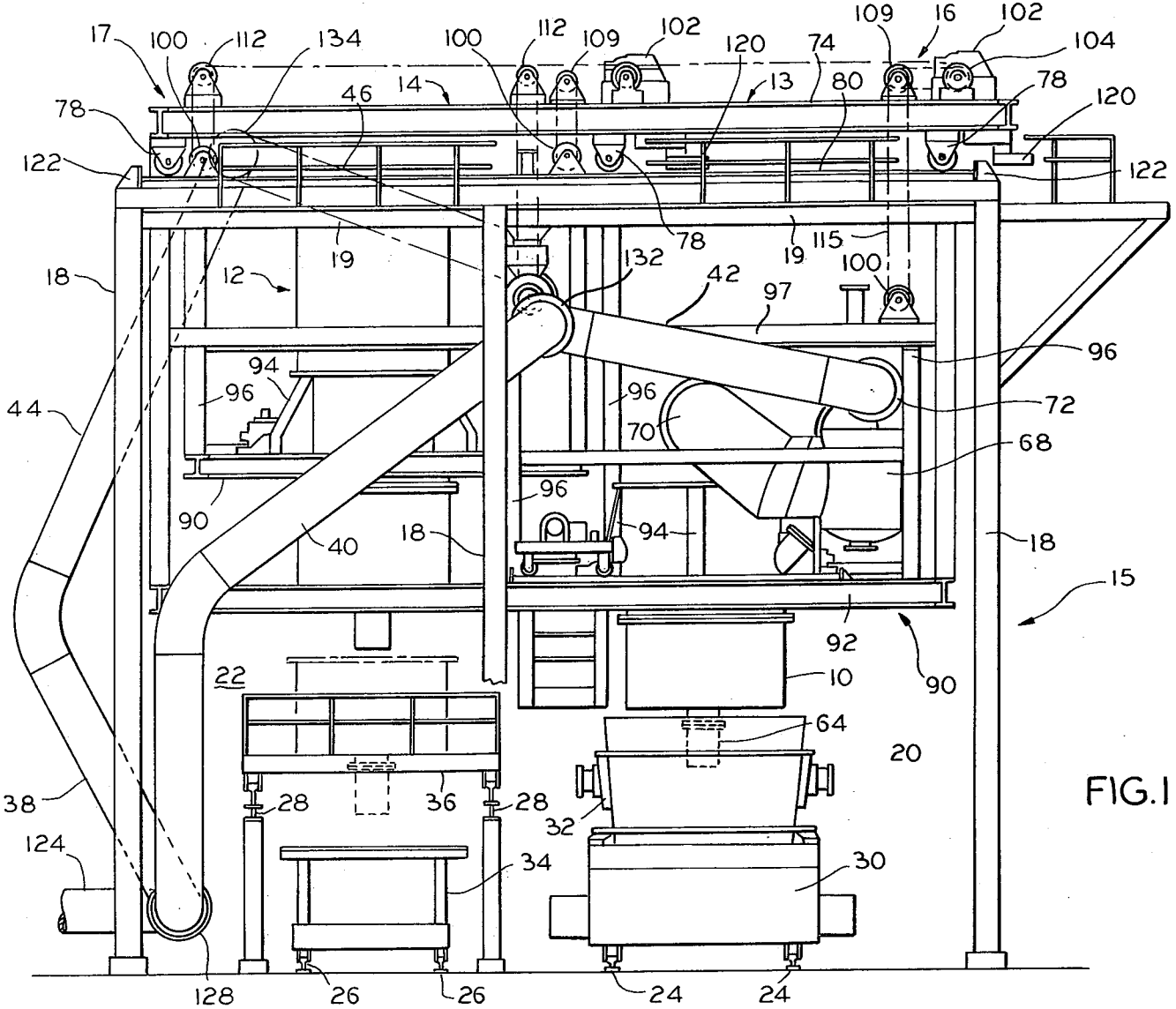
FIG. 1 is a side elevational view of a vacuum degassing apparatus according to the preferred embodiment of the present invention.
Figure 2:
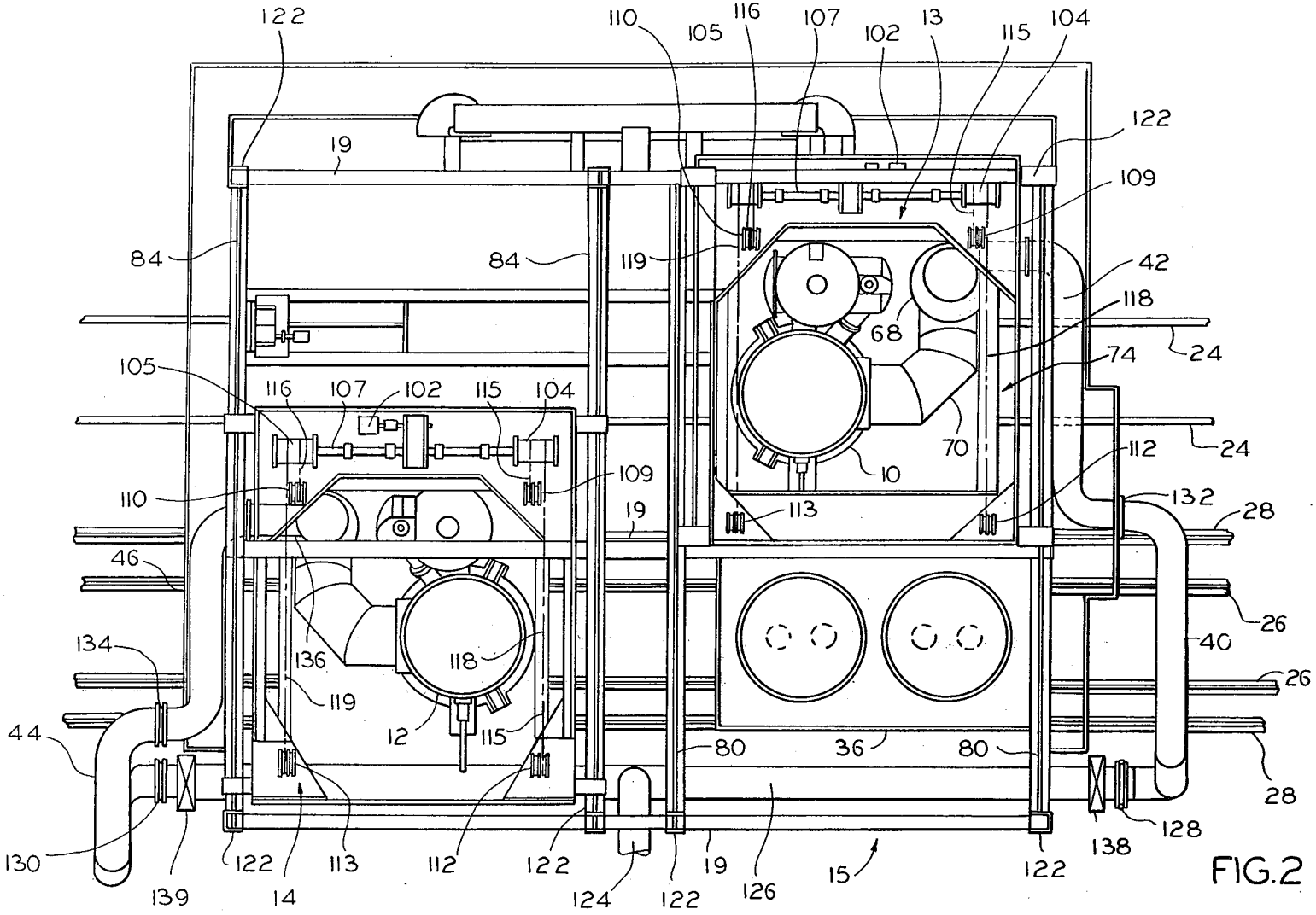
FIG. 2 is a plan view of the apparatus illustrated in FIG. 1.

FIGS. 1 and 2 show the vacuum degassing apparatus of the present invention to include a pair of vacuum degassing vessels 10 and 12 which are each supported by suspension assemblies 13 and 14, respectively, for horizontal and vertical movement on a framework 15 by individual vessel cars 16 and 17. The framework includes a plurality of suitably supported vertical beams 18 of structural steel and a plurality of cross members 19 which extend between the upper end of columns 18 for defining a treatment bay 20 and a maintenance bay 22. The cars 16 and 17 are mounted for rolling movement in a direction normal to the bays 20 and 22 so that each vessel 10 and 12 may be positioned over either bay independently of the other. For purposes of illustration, the vessel 10 is shown in FIG. 1 to be positioned in the treatment bay 20 and the vessel 12 is shown to be disposed in the maintenance bay 22.

Extending below the framework 14 and through the treatment bay 20 is a first pair of rails 24 while second and third pairs of rails 26 and 28 extend through the maintenance bay 22. The rails 24 support a ladle car 30 upon which a ladle 32 is disposed for movement through the treatment bay and rails 26 and 28, respectively, support a nozzle transfer car 34 at ground level and a vessel bottom car 36 at an elevated position relative to the car 34.

When a ladle 32 of hot metal 48 is positioned in bay 20 and below vessel 10, the latter may be lowered for vacuum treatment as will be discussed below. Simultaneously, the vessel 12 may be positioned in the treatment bay 22 for servicing as required. The vessels 10 and 12 are each coupled to a vacuum system (not shown) by a conduit assembly 38 comprising pairs of conduits 40, 42 and 44, 46 which are respectively pivotally connected to each other and to their associated vessels 10 and 12. In this manner, the vacuum connections may be maintained as the vessels 10 and 12 move between the treatment and service positions as well as while they are being raised and lowered.

Figure 3:
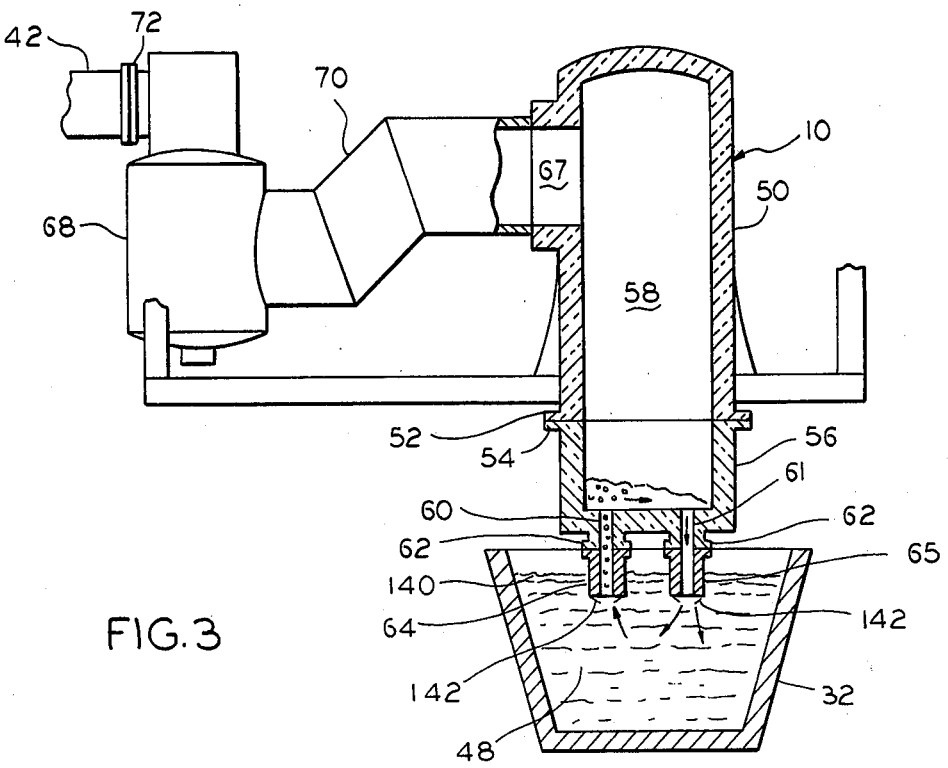
FIG. 3 schematically illustrates one of the vacuum degassing vessels of FIG. 1 in operative position.
Figure 4:
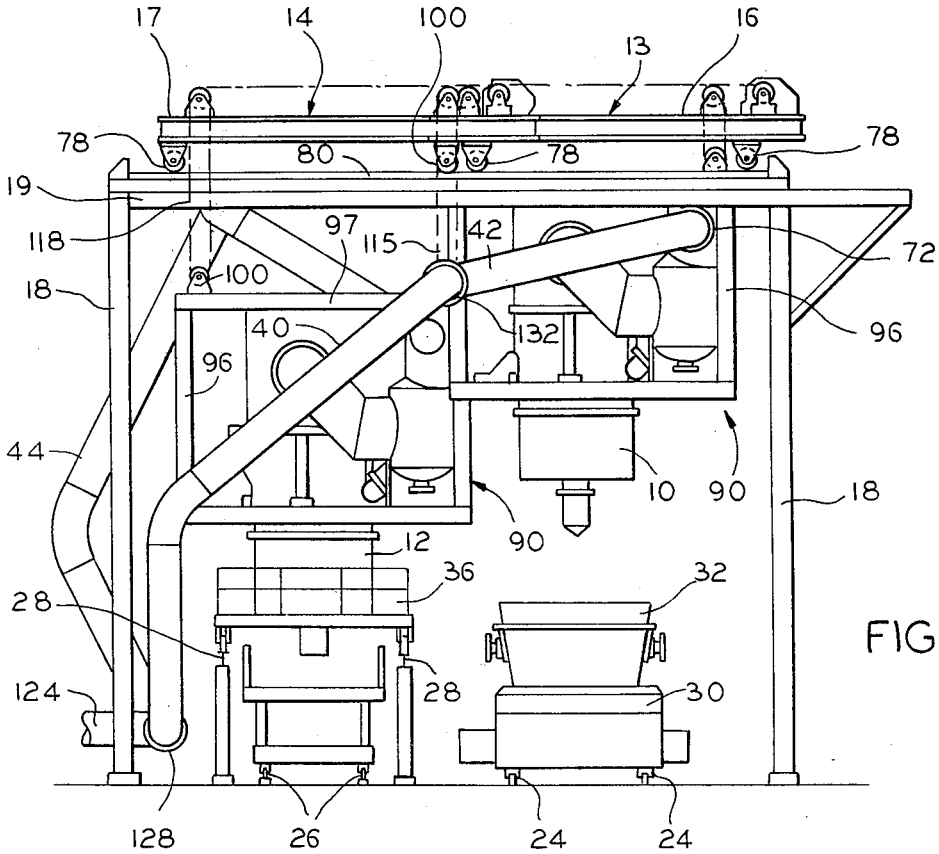
FIG. 4 schematically illustrates the vessels of FIG. 1 in an alternate position.

FIG. 3 shows the vessel 10 in position for treating molten metal 48, such as steel, in a ladle 32. In the illustrated embodiment, the vessel 10 includes an upper, generally cylindrical body portion 50 having a flange 52 at its lower end for being suitably affixed to the flange 54 at the upper end of a cup-shaped bottom portion 56. The upper body portion 54 and the bottom 56 when assembled define a vacuum chamber 58. A pair of spaced apart openings 60 and 61 connect to the lower end of bottom portion 56 and each has a flange 62 surrounding its lower end of the openings 60 and 61, respectively. A vacuum offtake opening 67 is also formed at the upper end of body portion 50 and is coupled to a dust collector and cooler 68 by a conductor 70. The conduit 42 is connected to the upper end of dust collector 68 by a rotary joint 70 to maintain the vacuum connection as the dust collector cooler 68 is raised and lowered along with vessel 10.

The suspension assemblies 13 and 14 and the cars 16 and 17 which support each vessel 10 and 12 are identical and accordingly, only car 16 and its suspension assembly 13 will be discussed in detail. However, the same reference numerals will be used for like components of each car and suspension assembly. Car 16 includes a generally rectangular frame 74 having rollers 78 at each corner and which in turn are mounted on rails 80 supported atop the horizontal frame members 19 at one side of the framework 14. The rails 80 extend generally normally to and span both bays 20 and 22. As seen in FIG. 2, a second pair of rails 84 are disposed on the members 19 at the opposite side of the framework 14 for supporting the car 17.

The suspension assembly 13 carried by car 16 is coupled to a platform 90 upon which the associated vessel 10 is mounted. Platform 90 includes a rectangular base 92 formed of suitable structural steel members which are engaged by brackets 94 affixed to the vessel 10 intermediate its ends. Columns 96 extend vertically from each corner of the base where their upper ends are jointed by cross members 97 to define a generally rectangular upper frame. At each corner of the upper frame is a pulley 100.

The elevation and suspension assembly 13 also includes a drive motor 102 mounted on car 16 and having a pair of drums 104, 105 mounted on its output shaft 107. In addition, there are a first pair of double sheave pulleys 109 and 110 mounted on car 80 for rotation about axes parallel to and adjacent drums 104 and 105, respectively. In addition, there are a second pair of sheaves 112 and 113 mounted for rotation about axes parallel to drums 104 and 105, respectively, but at their remote ends of the car 16. Cables 115 and 116 extend from drums 104 and 105, respectively, and over one sheave of pulleys 109 and 110 from which they pass downwardly and around one of the pulleys 100 and the platform 90 below from which each returns upwardly for attachment to the other sheave of corresponding pulleys 109 and 110. Additionally, cables 118 and 119, respectively, extend from drums 104 and 105 and each similarly couples to one of the pulleys 112 and 113 and to the pulleys 100 at the opposite end of the platform 90.

It will be appreciated that when the motor 102 is driven in a first direction, the platform 90 and the vessel 10 mounted thereon will be elevated while rotation of the motor 102 in the opposite direction will elevate the platform 90 in vessel 10. It will be appreciated that suitable limit switches may be provided for limiting the upward and downward movement of platform 90 to preselected limits.

A second motor 120 mounted on car 16 is coupled to one of the rollers 78 for driving car 16 along the rails 80 and between the treatment and service positions. In addition, suitable limit switches are provided to limit the rolling movement of car 16 while suitable stops 122 at the end of each rail are provided as a safety precaution. As indicated above, the car 16 and the car 17 are transported and positioned in an identical manner.

The conduit system 38 includes a first pipe 124 connected to the vacuum system (not shown) and to the midpoint of a second conduit 126 (FIG. 2) extending along the rear of the assembly. One end of conduit 126 is connected by a first rotary joint 128 to the lower end of conduit 40 and by a second rotary joint 130 to the lower end of conduit 44. The other end of conduit 40 is connected by a rotary joint 132 to one end of conduit 42, the other end of which is connected by a rotary joint 72 to the cooler collector 68 as indicated above. Similarly, rotary joint 134 couples conduits 44 and 46 to each other and rotary joint 136 couples conduit 46 to the dust trap and cooler 68 associated with vessel 12.

In operation, one of the vessels, such as vessel 10 for example, will be positioned over the treatment bay 20 by its car 16 while the second vessel 12 may be positioned over the service bay 22 by its car 17 as seen in FIG. 1. The ladle 32, which may contain molten ferrous metal from a BOF furnace, for example, is placed upon the car 30 which is then moved into the treatment bay on tracks 24 until the ladle 32 is positioned below vessel 10. The platform 90 is then lowered to immerse the lower end of the nozzles 64 and 65 beneath the surface 48 of the metal within ladle 32 as seen in FIG. 3. The valve 138 at the near end of conduit 126 is opened to couple the interior of vessel 10 to the vacuum system. As the pressure within the chamber 58 is reduced, the differential pressure will cause molten metal to flow from ladle 32 part way up the nozzles 64 and 65. In addition, inert gas such as argon is injected into nozzle 64 thereby reducing the specific gravity of the metal and causing the same to flow into chamber 58 where degasification occurs. The degassed metal having a higher specific gravity then flows downwardly through nozzle 65 for return to ladle 32. In this fashion, molten metal is circulated through the vessel 10 in a known manner until the contents of the ladle 32 have been degassed to the desired degree.

As schematically illustrated in FIG. 3, a layer of slag 140 may flow atop the metal 48. In order to prevent the entry of the slag into the vessel 10, slag breakers 142, as shown by broken lines in FIG. 3, are affixed at the lower end of each of the nozzles 64 and 65. Once submerged into the metal 48 the slag breakers will dissolve. Accordingly, it is necessary to affix such slag breakers to the nozzles between each treatment.

When the system according to the invention is employed with a BOF vessel, treatment cycles occur about every 48 minutes. In other words, hot metal will be tapped from the BOF vessel at about that frequency rate. The vacuum treatment will typically require about 30 minutes while about 15 minutes are required for the attachment of slag breakers. Thus, one vessel could conceivably service a BOF vessel on a continuous basis of other maintenance requirements were disregarded. However, in order to prolong the life of the nozzles, it is generally required that they be allowed to cool between operations. The cooling and attachment of slag breakers normally requires about 55 minutes, with two vessels working alternately, the nozzles of one vessel can be cooled and slag breakers attached while the other vessel is treating a ladle of molten metal. Thus, while the vessel 10 is treating a ladle of molten metal, the nozzles of vessel 12 are being cooled after which slag breakers are attached. After completion of the degasification of the metal within the ladel 32 by vessel 10, the latter is elevated by its elevating mechanism 76 after which it is transported by its car 16 over the maintenance bay 22. Simultaneously, the vessel 18 which has just been serviced may be transported to the treatment bay 20 in preparation for a second ladle of molten metal. When the second ladle 32 is positioned beneath vessel 12, the latter is lowered into its treatment position while the vessel 10 is cooling and otherwise being serviced.

The tandem array of vessels also permits longer maintenance procedures. For example, about once every five treatment cycles, it is necessary for more extensive nozzle repair which may take as much as one and one-half hours. Under these circumstances, the other vessel will be used in two consecutive heats, thus permitting substantially continuous utilization. Also, approximately every 60 heats the nozzles must be exchanged by disengaging the nozzles from flanges 62, for example. This procedure requires about one and one-half hours and again, while the snorkels are being replaced on one vessel, the other vessel is operated on successive sheaths. Finally, major procedures such as replacement of vessel bottoms and the like can be accomplished during periods when the BOF vessel is also being serviced.

It can thus be seen, that the apparatus according to the present invention allows substantially continuous degassing of molten metal as the same is brought from a BOF vessel at intervals of about forty-five minutes. This is true regardless of the fact that the degassing vessels and particularly the nozzles require periodic cooling and maintenance at intervals much more frequent than that required by the BOF vessel.

While the invention has been illustrated and described in relation to a two nozzle vessel, it will be appreciated that it also has application to single nozzle vessels as well. In that case each of the vessels 10 and 12 would be replaced by a single nozzle vessel which would be operated in the manner discussed in U.S. Pat. No. 2,967,768. Otherwise, movement of the vessels between operation and maintenance positions would be identical to that discussed above.

Accordingly, while only a single embodiment of the invention has been illustrated and described, it is intended to be limited thereby but only by the scope of the appended claims.

I claim:

1. Vacuum degassing apparatus including first and second vacuum degassing vessels, coupling means for connecting each vessel to a vacuum system for reducing the pressure therein, each vessel having at least one nozzle extending from its lower end whereby molten metal can be drawn into said vessel for being degassed, supporting means, first and second transport means each including a vessel support, said first and second vessels being mounted respectively on said first and second vessel supports, said first and second transport means being mounted respectively on said supporting means, said first and second transport means being mounted in a side-by-side relation and each being movable in a direction generally parallel to that of the other for transporting its associated vessel between a treatment position and a service position, means for transporting a container of metal beneath the treatment positions of each vessel, each said first and second transport means including elevating means coupled to its vessel support so that each vessel may be elevated and lowered individually when each is in its treatment or service positions, and connecting means connected to each of said vessels and to said coupling means for providing a vacuum connection therebetween, said connecting means being constructed and arranged to maintain said vacuum connections as said vessels are moved between their treatment and service positions and during the raising and lowering thereof.

2. The apparatus set forth in claim 1 and including frame means, first and second generally parallel track means mounted on said frame means, said first and second transport means comprising individual cars mounted respectively on said first and second track means.

3. The apparatus set forth in claim 2 wherein said first and second vessel supports comprise platform means each of which supports its associated vessel, said elevating means coupling said platform means to one of said cars whereby each said platform means are movable vertically relative to its associated car.

4. The apparatus set forth in claim 3 wherein said vessel elevating means comprises drum means mounted on each car and a plurality of pulleys mounted in spaced apart relation on said vessel supports cable means extending between said drum means and said pulley means, and drive means for rotating said drum means whereby said vessel supports may be elevated and lowered.

5. The apparatus set forth in claim 1 wherein said coupling means comprises fixed conduit means adapted to be connected to a vacuum system, first and second conduit means, first and second rotary joint means for coupling said first and second conduit means to said first and second vessels respectively, third and fourth rotary joint means for coupling said first and second conduit means to said fixed conduit means respectively, whereby the connections between said vessels and said conduit means are maintained as said vessels are moved between their operative and service positions during the raising and lowering thereof.

6. The apparatus set forth in claim 5 wherein each said first and second conduit means comprises a pair of conduits, a rotary joint interconnecting the conduits of each pair whereby said conduits articulate as said vessels are elevated and lowered and moved between their respective positions.

7. The apparatus set forth in claim 6 and including frame means, first and second generally parallel track means on said frame means, said first and second transport means comprising individual cars mounted respectively on said first and second track means.

8. The apparatus set forth in claim 7 wherein said first and second vessel supports comprise platform means each of which supports its associated vessels, said vessel elevating and lowering means coupling each of said platforms to one of said cars whereby said platforms are movable vertically relative to its associated car.

9. The apparatus set forth in claim 8 wherein said vessel elevating and lowering means comprises drum means mounted on each car and a plurality of pulleys mounted in spaced apart relation on said platform, cable means extending between said drum means and said pulley means, and drive means for rotating said drum means whereby said platforms may be elevated and lowered.

10. Vacuum degassing apparatus including first and second vacuum degassing vessels, coupling means for connecting each vessel to a vacuum system for reducing the pressure therein, each vessel having a pair of nozzles extending from its lower end whereby molten metal can be drawn into said vessel through one nozzle for being degassed and discharged from said vessel through a second nozzle, first and second transport means each including a vessel support, said first and second vessels being mounted respectively on said first and second vessel supports, a support, said first and second transport means being mounted on said support in a side-by-side relation and each being movable in a direction generally parallel to that of the other for transporting its associated vessel between a treatment position and a service position, transport means for transporting a container of metal in a direction generally normal to that in which said transport means are movable and beneath the treatment positions of each vessel, first and second vessel elevating and lowering means respectively coupling said first and second vessel supports to said first and second transport means so that each vessel may be elevated and lowered individually when each is in its treatment or service positions, said coupling means including conduit means communicating with said vacuum system and connecting means for providing a vacuum connection between said conduit means and each of said vessels, said connecting means being constructed and arranged to maintain said vacuum connections as said vessels are moved between their treatment and service positions and during the raising and lowering thereof.

11. The apparatus set forth in claim 10 wherein said conduit means comprises fixed conduit means adapted to be connected to a vacuum system, first and second conduit means, and first and second rotary joint means for coupling said first and second conduit means to said fixed conduit means respectively.

12. The apparatus set forth in claim 11 wherein each said first and second conduit means comprises a pair of conduits, a rotary joint interconnecting the conduits of each pair whereby said conduits articulate as said vessels are elevated and lowered and moved between their respective positions.

13. Vacuum degassing apparatus including first and second vacuum degassing vessels, coupling means for connecting each vessel to a vacuum system for reducing the pressure therein, each vessel having at least one nozzle extending from its lower end whereby molten metal can be drawn into said vessel for being degassed, supporting means, transport means mounted on said supporting means and including vessel support means, said first and second vessels being mounted respectively on said vessel support means, said transport means being movable on said supporting means in a first direction for transporting said vessels between a treatment position and a service position, means for transporting a container of metal in a second direction and beneath the treatment positions of each vessel, said transport means including elevating means coupled to its vessel supports so that each vessel may be elevated and lowered individually when each is in its treatment or service positions, said coupling means including conduit means connected to said vacuum system and connecting means for providing a vacuum connection between said conduit means and each of said vessels, said connecting means being constructed and arranged to maintain said vacuum connections as said vessels are moved between their treatment and service positions and during the raising and lowering thereof.

14. The apparatus set forth in claim 13 wherein said conduit means comprises fixed conduit means adapted to be connected to a vacuum system, first and second conduit means, and first and second rotary joint means for coupling said first and second conduit means to said fixed conduit means respectively.

15. The apparatus set forth in claim 14 wherein each said first and second conduit means comprises a pair of conduits, a rotary joint interconnecting the conduits of each pair whereby said conduits articulate as said vessels are elevated and lowered and moved between their respective positions.

* * * * *